US006474251B1

(12) United States Patent
Vidallet et al.

(10) Patent No.: US 6,474,251 B1
(45) Date of Patent: Nov. 5, 2002

(54) CREMATING METHOD AND CREMATOR

(76) Inventors: Pierre Robert François Vidallet, 1044, rue du Bois, 59232 Vieux-Berquin (FR); Leendert Antonius Kleinschmidt, Lepelaar 9, Brock OP, Langedijk 1721 DA, Pays-Bas (NL)

( * ) Notice: Subject to any disclaimer, the term of this patent is extended or adjusted under 35 U.S.C. 154(b) by 0 days.

(21) Appl. No.: 09/380,853

(22) PCT Filed: Mar. 10, 1998

(86) PCT No.: PCT/FR98/00469

§ 371 (c)(1),
(2), (4) Date: Dec. 14, 1999

(87) PCT Pub. No.: WO98/40671

PCT Pub. Date: Sep. 17, 1998

(30) Foreign Application Priority Data

Mar. 10, 1997 (FR) ..... 97 03143

(51) Int. Cl.[7] ..... F23G 1/00; F23B 5/00; F23J 11/00

(52) U.S. Cl. ..... 110/345; 110/194; 110/210; 110/213; 110/214

(58) Field of Search ..... 110/194, 190, 110/210, 213, 214, 345, 347

(56) References Cited

U.S. PATENT DOCUMENTS

| | | | | | |
|---|---|---|---|---|---|
| 3,805,714 | A | * | 4/1974 | Sharpe | 110/8 R |
| 3,874,310 | A | * | 4/1975 | Falling | 110/3 |
| 4,291,633 | A | * | 9/1981 | Hoskinson | 110/235 |
| 4,294,178 | A | * | 10/1981 | Borio et al. | 110/347 |
| 4,321,878 | A | * | 3/1982 | Segrest | 110/194 |
| 4,515,089 | A | * | 5/1985 | Ehrlichmann | 110/235 |
| 4,531,463 | A | * | 7/1985 | Kratz et al. | 110/212 |
| 4,542,703 | A | * | 9/1985 | Przewalski | 110/246 |
| 4,570,551 | A | * | 2/1986 | Derbridge et al. | 110/263 |
| 5,146,858 | A | * | 9/1992 | Tokuda et al. | 110/261 |
| 5,520,123 | A | * | 5/1996 | Chappell et al. | 110/188 |
| 5,926,933 | A | * | 7/1999 | Kaehr | 29/402.08 |
| 5,957,065 | A | * | 9/1999 | Hough et al. | 110/194 |

FOREIGN PATENT DOCUMENTS

| | | | |
|---|---|---|---|
| DE | 1176781 | 8/1964 | |
| DE | 1258009 | 1/1968 | |
| GB | 1 563 386 | 3/1980 | |
| JP | 55-20369 | * 2/1980 | 110/194 |
| WO | WO 90/14558 | 11/1990 | |

* cited by examiner

*Primary Examiner*—Henry Bennett
*Assistant Examiner*—K. B. Rinehart
(74) *Attorney, Agent, or Firm*—Wolf, Greenfield & Sacks P.C.

(57) ABSTRACT

The invention concerns a method for cremating human or animal bodies which consists in generating from a wall (10) of the combustion chamber (3), a turbulence in the form of a vertical displacement above the body (2) and in injecting the air required for combustion into this turbulence. Preferably, the turbulence is generated by rotating means (11) directed inside the chamber (3) and equipped with an inlet air duct (17), provided with a closing valve (18) and the air injection is adjusted by actuating the valve.

19 Claims, 2 Drawing Sheets

CREMATING METHOD AND CREMATOR

Figure 1:
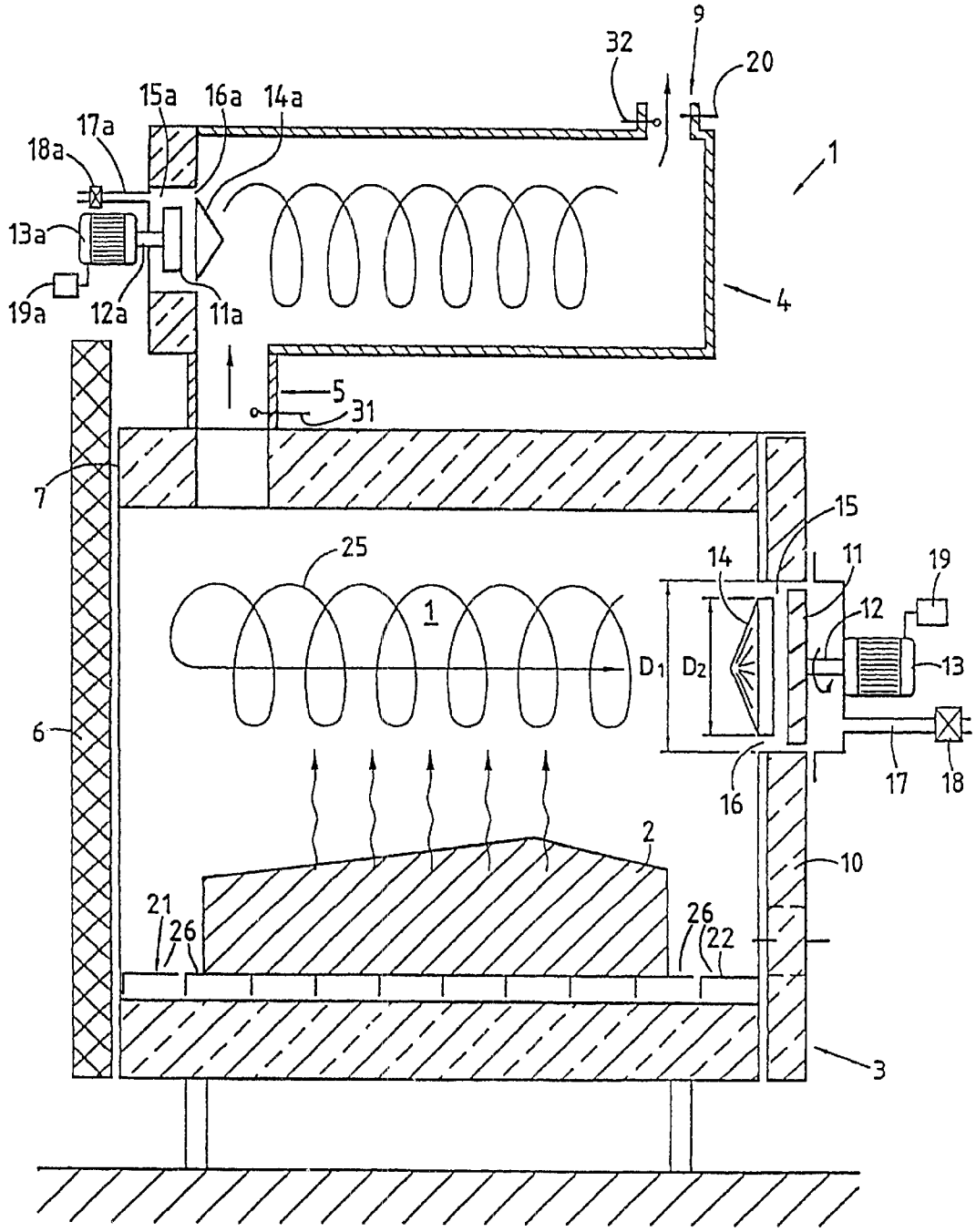

The present invention relates to a method for cremating human or animal bodies in a combustion chamber, method whereby the interior atmosphere of the chamber is taken to very high temperature then the body to be incinerated, in its coffin, is introduced, the interior temperature of the chamber being sufficiently high to provoke combustion of the coffin and the body and air is injected into the chamber to supply combustion with oxygen. It also relates to a cremation furnace comprising a combustion chamber, preferably a post-combustion chamber, means for taking the interior atmosphere of the or said chambers to very high temperature and air injection means.

The temperature to which the atmosphere inside the combustion chamber is to be taken is of the order of 800° C. This temperature is obtained by any appropriate means, burner or heating element. In order to obtain cremation of the body, it is necessary to supply the combustion chamber with oxygen; this is effected by injection of air all along the cremation. This supply of outside air, which is cold, relatively to the temperature of the chamber, necessitates maintaining the heating means in action.

The gaseous rejects from a cremation furnace are subjected to severe standards. This is why cremation furnaces comprise a post-combustion chamber whose temperature is generally high, of the order of 850° C. The standards impose a minimum retention time, i.e. a minimum time during which a certain gaseous volume must dwell in the post-combustion chamber at the temperature in question. This retention time has been determined so as to avoid any detrimental gaseous rejection into the atmosphere, particularly of dioxin.

The purpose that Applicants have set is to propose a method of cremation which makes it possible to optimalize the consumption of energy of the furnace while respecting the quality of the gaseous rejections.

This purpose is perfectly attained by the method of cremation of the invention wherein, in characteristic manner, a turbulence is created from a wall of the combustion chamber, in the form of a swirling displacement above the body and the air required for combustion is injected into this turbulence.

An intimate mixture of the fuels, close to the stoichiometric ratio, may thus be made in the interior volume of the chamber. The turbulence is preferably generated by a rotating means directed inside the chamber and equipped with an air inlet duct, provided with a closing valve and the air injection is adjusted by actuating the valve. According to this particular arrangement, the air is sucked from the duct due to the depression created by the rotating means and moves inside the chamber at the same time as the turbulence generated by said means.

The method of the invention advantageously comprises, on the one hand, a step of pre-heating of the combustion chamber during which the rotating means rotates at reduced speed, for example 25 Hz, and the air inlet valve is closed and, on the other hand, a step of cremation proper during which the rotating means rotates at high speed, for example 40 Hz, and the valve is open. The turbulence, of lesser importance, generated during the operation of pre-heating, without injection of air, makes it possible to homogenize the temperature inside the chamber.

Opening of the valve is preferably adjusted in order to maintain the rate of oxygen of the gases evacuated from the furnace to a minimum threshold, for example of the order of 6 or 7%. This rate corresponds to the standards in force.

Applicants have ascertained that, when the cremation furnace also comprises a post-combustion chamber, thanks to the method of the invention, it was possible to obtain the regulatory conditions of gaseous rejects for a retention time clearly less than the threshold imposed.

It is another object of the invention to propose a cremation furnace especially designed for carrying out the method mentioned above, this furnace comprising in known manner a combustion chamber, means for taking the interior atmosphere of the chamber to high temperature and means for injecting air. In characteristic manner, the furnace of the invention also comprises a rotating means which is built in a wall of the combustion chamber, above the location of the body, directed towards the interior of said chamber, being adapted to generate a swirling displacement of the atmosphere; this rotating means is equipped with an air inlet duct on which an adjustable closing valve is placed.

According to a preferred version, the interior volume of the combustion chamber is cylindrical, with a door disposed in one of the two circular transverse walls and the rotating means is placed in the transverse wall opposite the door. The interior cylindrical shape is combined with the swirling displacement in order to ensure the desired homogeneous mixture.

Being question of a cremation furnace whose combustion chamber comprises a sole piece, intended to receive the body, which lines the lower part of said chamber, the sole piece characteristically presents a continuous inner cavity opening out laterally towards the interior volume of the chamber. In this way, during the swirling displacement, the hot atmosphere which is found in the chamber also circulates in the continuous interior cavity of the sole piece so that the latter remains constantly at the temperature of the chamber.

The rotating means advantageously comprises plane, radial blades, mounted on a rotating shaft and disposed axially in a substantially cylindrical housing; moreover, a circular protection screen partially and centrally obturates the circular face of the housing which is turned towards the inside of the chamber; finally, the rotating means also comprises a means for driving the shaft at variable speed.

The circular screen performs a double role. On the one hand, it ensures thermal protection of the blades and, on the other hand, it generates the swirling displacement from an annular zone.

In a preferred embodiment in which the cremation furnace comprises a principal combustion chamber and a post-combustion chamber connected to the principal chamber by a ferrule equipped with a chimney stack for evacuation of the gaseous rejects, each chamber is provided, in characteristic manner, with a rotating assembly mentioned above with variable speed drive, an oxygen sensor is disposed in the chimney stack for evacuation of the gaseous rejects, a heat probe makes it possible to measure the temperature of the combustion chamber and the cremation furnace comprises an electronic control circuit, with clock, said circuit being connected to the oxygen sensor, to the heat probe, to the variable speed drives of the two rotating means and to the closure valves of the two air inlet ducts, said electronic circuit being programmed so as to carry out the following steps:

a) a step of pre-heating which lasts as long as the temperature measured by the heat probe has not reached a determined threshold, of the order of 800° C. for the combustion chamber and 850° C. for the post-combustion chamber and during which the variable speed drive of the first rotating means of the principal chamber rotates at low speed, of the order of 25 Hz, the valve being in position of closure, b) a step of cremation proper during which the first motor of the rotating element of the principal chamber passes progressively from the low speed to a higher speed then remains stationary at said high speed, of the order of 40 Hz, the second motor of the rotating element of the post-combustion chamber being actuated to rotate at low speed, of the order of 25 Hz and the valves being open so that the rate of oxygen measured by the sensor remains less than a determined threshold, of the order of 7%.

The present invention will be more readily understood on reading the following description of a preferred embodiment of a cremation furnace comprising a principal combustion chamber and a post-combustion chamber subjected to swirling displacement, illustrated by the accompanying drawings, in which:

FIG. 1 schematically shows the furnace in longitudinal section.

Figure 2:
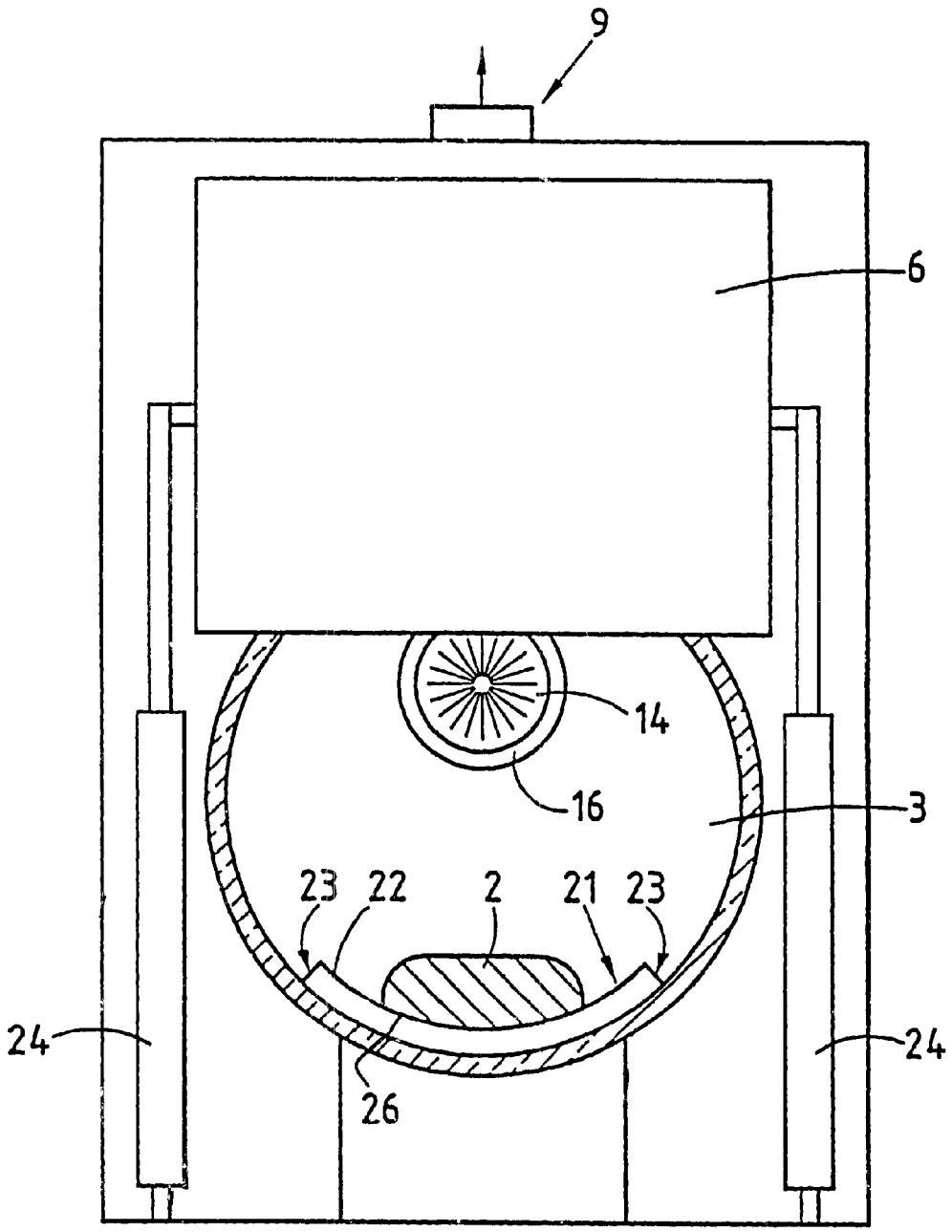

FIG. 2 schematically shows the furnace in front view.

The furnace 1 of the invention is intended for cremating human or animal bodies 2, said bodies generally being previously placed in a coffin. This furnace 1 comprises a principal combustion chamber 3 and a post-combustion chamber 4, disposed above the principal chamber 3 and connected thereto by a ferrule 5. These two chambers are generally cylindrical in form.

In the example illustrated, the post-combustion chamber 4 is disposed above the principal chamber 3, their axes of symmetry being in the same vertical plane.

A door 6 makes it possible to open the principal chamber 3 along the circular front wall 7. The door illustrated in FIG. 2 opens vertically thanks to hydraulic jacks 8. It may, of course, be question of any other type of door and system of opening.

Each of the two chambers 3, 4 is equipped with heating systems (not shown), for example burners or heating elements, making it possible to take the temperature inside the principal chamber to about 800° C. and that of the post-combustion chamber to about 850° C.

When the body 2 has been introduced in the principal chamber 3, the temperature of 800° C. is such that it provokes combustion of the coffin, then of the body, provided that the interior atmosphere of the principal chamber 3 is supplied with oxygen, such supply being effected conventionally by injection of air. The temperature of 850° C. in the post-combustion chamber 4 makes it possible to obtain cracking of the gases coming from combustion, the volume of the post-combustion chamber 4 and the flowrate of these gases being such that the gaseous rejects leaving via the chimney stack 9 of the post-combustion chamber 4 comply with the regulatory standards, no longer containing rejects considered as noxious for the environment.

In characteristic manner, according to the invention, the cremation furnace 1 is equipped with at least one means for obtaining in the principal chamber 3 a swirling displacement above the body 2 from one of the walls 10 of said chamber 3.

This swirling displacement is generated by blades 11 which are plane and disposed radially with respect to a rotating shaft 12, being driven by a motor 13 with variable speed drive 19. These blades are placed in a housing, formed in the wall 10, opposite the door 6. This housing 15, of circular cross-section of diameter D1, is partially obturated by a screen 14, itself of circular cross-section of diameter D2, smaller than D1, defining in the wall 10 an annular space opening out in the inner volume of the chamber 3. The blades 11 have a diameter which is substantially equal to D1, so that they are protected by the screen 14.

An air inlet duct 17, on which a valve 18 is mounted, opens out in the housing 15.

The post-combustion chamber 4 is equipped with the same means for obtaining a swirling displacement of the inlet of the ferrule 5 up to the evacuation chimney stack 9. This means has been shown in FIG. 1 with the same references to which index a is added.

Temperature sensors make it possible to measure the temperature both in the combustion chamber 3 and in the combustion chamber 4. An oxygen sensor 20 makes it possible to measure the rate of oxygen in the gaseous rejects leaving via the evacuation chimney stack 9. The operation of the cremation furnace 1 is controlled by an electronic control circuit with lock, which is connected to the heat probes, to the oxygen sensor 20, to the variable speed rives 19, $\mathbf{19}_a$ and to the closure valves 18, $\mathbf{18}_a$ of the two air inlet ducts 17, $\mathbf{17}_a$.

Rotation of the blades 11 in the housing 15 provokes the formation, from the annular space 16, of a swirling displacement of the atmosphere contained in the combustion chamber 3 with a displacement which is symbolized by the line referenced 25 in FIG. 1. Applicants have, moreover, noted that this swirling displacement bounced to some extent on the inner face of the door 6 opposite the annular space 16. Thanks to this swirling displacement, an intimate mixture is obtained of all the gases which are located in the combustion chamber above the body 2.

The air necessary for combustion of the body 2 is injected in this swirling displacement, by actuating the valve 18 disposed on the air inlet duct 17. In this way, an intimate mixture is obtained, very efficiently, of the gases located in the chamber 3 and of the air injected into said chamber.

According to a preferred modus operandi, control of the furnace 1 thanks to the electronic control circuit is effected in accordance with the following steps. During a first step of pre-heating, the temperature of chambers 3 and 4 is taken, thanks to traditional means (not shown), to about 800° C. in the combustion chamber 3 and 850° C. in the post-combustion chamber 4. During this first step, the variable speed drive 19 of the motor 13 is adjusted so that the blades 11 rotate at low speed, of the order of 25 Hz, the valve 18 disposed on the air inlet duct 17 being closed. During this first step, a slight swirling displacement is therefore obtained, intended mainly to obtain a better distribution of the heat inside the combustion chamber 3, without injection of air. During this first step, no swirling displacement is generated in the post-combustion chamber 4.

Once the temperature thresholds have been reached, the second step of cremation proper begins. The electronic circuit triggers off, by the variable speed drive 19, an increase of the rotation of the blades 11 to a greater speed, of the order of 40 Hz. In parallel, the same electronic circuit triggers off the actuation, by the variable speed drive $\mathbf{19}_a$, of blades $\mathbf{11}_a$ at reduced speed, of the order of 25 Hz, provoking a swirling displacement within the post-combustion chamber 4. During this second step, the electronic circuit controls the opening of the valves 18 and $\mathbf{18}_a$ and therefore injection of air in the chambers 3, 4 so that the rate of oxygen measured by sensor 20 remains less than a predetermined threshold, of the order of 7%.

At the end of cremation, the electronic circuit controls the progressive stop of the blades 11 and $\mathbf{11}_a$ and the closure of valves 18 and $\mathbf{18}_a$.

The body 2 usually rests on a sole piece 21, which is made of a refractory material and which lines the inner lower part of the combustion chamber 3. In characteristic manner, this sole piece 21 is recessed so that the swirling displacement generated in the combustion chamber may also move in this recess. To that end, the sole piece 21 is constituted by unitary elements 22 having in cross-section the form of an upturned U. These elements 22 are attached to one another with their recesses, constituted by the inner part 20 of the U which are adjacent and which open out in the lateral faces 23 of the sole piece. The swirling displacement thus passes between the cylindrical inner wall of the combustion chamber 3 and the upper face of the sole piece 21 which supports the body 2. This particular arrangement presents the advantage of maintaining the sole piece at the ambient temperature of the combustion chamber 3, thanks to the circulation within the recess.

It will be understood that the cyindrical form of the combustion chamber 3 and of the post-combustion chamber 4 contribute to rendering even more homogeneous the mixture of the gases located inside the said chambers due to the swirling displacement, this configuration not presenting any dead zone.

The screen 14, $\mathbf{14}_a$ which is located opposite blades 11, $\mathbf{11}_a$ has a shape of generally circular cross-section of diameter D2. In practice, this screen may be in the form of a cone as illustrated in FIG. 1, this shape contributes, on the one hand, to the formation of the swirling displacement on leaving the space 16 and, on the other hand, contributes to a better thermal protection of the blades 11, $\mathbf{11}_a$ thanks to a better diffusion by reverberation of the heat coming from chambers 3, 4.

The present invention is not limited to the embodiment which has just been described by way of non-exhaustive example. In particular, the post-combustion chamber is not obligatorily arranged above the combustion chamber, but may be located to the side thereof and parallel thereto. Concerning the closure of the combustion chamber, FIG. 2 shows the closure of the door 6 with the aid of two jacks 24 adapted to displace said door 6 vertically, in sliding manner in front of the entrance of the chamber; any other type of closure may, of course, be envisaged.

What is claimed is:

1. A method for cremation of human or animal bodies in a combustion chamber comprising:

heating an interior atmosphere of the combustion chamber to a high temperature;

introducing a body to be incinerated in its coffin into the combustion chamber, an interior temperature of the combustion chamber being sufficiently high to provoke combustion of the coffin and of the body;

creating a turbulence from a wall of the combustion chamber as a swirling displacement above the body, the turbulence being generated by a rotating means; and injecting air to supply oxygen for combustion into the turbulence.

2. The method of cremation according to claim 1, wherein the rotating means has an air inlet duct with a closure valve and wherein the air being injected is adjusted by actuation of the closure valve.

3. The method of cremation according to claim 2, further comprising pre-heating the combustion chamber during which the rotating means rotates at a reduced speed of about 25 Hz and the closure valve is closed and cremating the body during which the rotating means rotates at a high speed of about 40 Hz, and the closure valve is open.

4. The method of cremation according to claim 2, wherein the closure valve is adjusted to maintain the oxygen in a gas evacuated from the combustion chamber at a threshold of less than about 6 or 7%.

5. A furnace for carrying out the method of claim 1, comprising the combustion chamber, means for taking the interior atmosphere of the combustion chamber to a high temperature and air injection means, wherein the rotating means is built in a wall of the combustion chamber above the body and is directed towards the inside of said combustion chamber to create a swirling displacement of the atmosphere and is equipped with an air inlet duct having an adjustable closure valve.

6. The furnace according to claim 5, further comprising a door disposed in a transverse wall opposite the wall wherein the rotating means is placed and wherein an interior volume of the combustion chamber is cylindrical in shape.

7. The furnace according to claim 5, wherein the combustion chamber comprises a sole piece for receiving the body, said sole piece lining the lower part of said combustion chamber and having a unitary element with an upturned U cross-section, said unitary element presenting a continuous inner part opening out laterally towards an internal volume of the combustion chamber.

8. The furnace according to claim 5, wherein the rotating means comprises plane and radial blades mounted on a rotating shaft and disposed axially in a substantially cylindrical housing, a circular protection screen partially and centrally obturating a circular face of the cylindrical housing which faces toward the inside of the chamber, and a means for driving the rotating shaft at variable speed.

9. The furnace according to claim 5 wherein said combustion chamber comprises:

a principal combustion chamber;

a post-combustion chamber connected to the principal combustion chamber by a ferrule;

a chimney stack for evacuation of a gas;

a rotating assembly with a variable speed drive disposed in each of the principal and post-conduction chambers;

an oxygen sensor disposed in the chimney stack;

a heat probe for measuring temperatures of the principal combustion and post-combustion chambers; and an electronic control circuit with a clock, said electronic control circuit being connected to the oxygen sensor to the heat probe, to the variable speed drive and to the closure valve and being programmed to carry out the following steps:

pre-heating until a temperature of the principal combustion chamber measured by the heat probe has reached a determined threshold of about 800° C. and a temperature of the post-combustion chamber is about 850° C.;

during the pre-heating step, rotating the variable speed drive of the rotating assembly of the principal combustion chamber at a low speed of about 25 Hz and closing the closure valve;

b) cremating the body while the rotating assembly of the principal combustion chamber passes progressively from the low speed to a higher speed and then remains stationary at said higher speed of about 40 Hz, and while the rotating assembly of the post-combustion chamber is actuated to rotate at low speed, of about 25 Hz and while the closure valve opens so that oxygen measured by the oxygen sensor remains less than a determined threshold of about 7%.

10. A method of cremation of human or animal bodies in a furnace having a combustion chamber, said method comprising:

pre-heating the combustion chamber to a chamber temperature;

introducing the body into the combustion chamber;

creating a swirling displacement in the combustion chamber directed into the combustion chamber using a rotating apparatus;

heating the combustion chamber to a temperature sufficient to combust the body; and injecting air into the swirling displacement through an air inlet duct.

11. The method of claim 10, wherein the injecting step comprises adjusting a closure valve in the air inlet duct so that an oxygen content of a gas leaving the combustion chamber is less than about 7%.

12. The method of claim 10, wherein said creating step further comprises positioning the swirling displacement above the body.

13. The method of claim 10, wherein the step of placing the body in the combustion chamber comprises passing the body through a door in a wall of the furnace opposite from a wall on which the rotating apparatus is disposed.

14. The method of claim 10, wherein the step of placing the body in the combustion chamber comprises setting the body on a sole piece lining a lower part of the combustion chamber and wherein the sole piece has unitary elements with an upturned U cross-section and a continuous inner part opening toward an internal volume of the combustion chamber.

15. The method of claim 10, wherein said creating step comprises the step of operating the rotating apparatus at about 25 Hz until a temperature threshold is reached and operating the rotating apparatus at about 40 Hz after a temperature threshold has been reached.

16. The method of claim 10, further comprising:

evacuating a gas through a chimney stack connected to a post-combustion chamber of the furnace;

measuring an oxygen rate of the gas being evacuated with an oxygen sensor in the chimney stack;

measuring a temperature of the post-combustion chamber and a temperature of a principal combustion chamber with a heat probe;

controlling the furnace with an electronic control circuit;

operating a principal combustion chamber rotating apparatus and a post-combustion chamber rotating apparatus at about 25 Hz and maintaining no air flow until the principal combustion chamber reaches a temperature of about 800° C. and the post-combustion chamber reaches a temperature of about 850° C.;

cremating the body while operating the principal chamber rotating apparatus at about 40 Hz after a temperature of the post-combustion chamber is at least about 850° C.; and adjusting the air flow to maintain an oxygen level in the gas being evacuated through the chimney stack at less than about 7%.

17. A cremating furnace comprising:

a combustion chamber comprising a principal combustion chamber, a post-combustion chamber coupled to the principal combustion chamber by a ferrule and a chimney stack connected to the post-combustion chamber for evacuating a gas;

apparatus associated with the combustion chamber for taking the interior atmosphere of the combustion chamber to a high temperature;

a principal combustion chamber rotating assembly disposed in the principal combustion chamber for creating a swirling displacement directed inwardly of the principal combustion chamber and comprising a principal combustion chamber variable speed drive;

a post-combustion chamber rotating assembly disposed in the post-combustion chamber for creating a swirling displacement directed inwardly of the post-combustion chamber and comprising a post-combustion chamber variable speed drive;

an oxygen sensor disposed in the chimney stack;

a heat probe disposed in at least one of the principal combustion chamber and the post-combustion chamber; and an air injector disposed at least in the principal combustion chamber for injecting air into the swirling displacement of at least the principal combustion chamber and comprising an adjustable closure valve and an air inlet duct.

18. The cremating furnace of claim 17, further comprising a door disposed in a wall of the principal combustion chamber opposite from a wall on which the principal combustion chamber rotating assembly is disposed.

19. The cremating furnace of claim 17, further comprising a sole piece lining at least a portion of a lower part of the principal combustion chamber and having a U-shaped unitary element.

* * * * *